US006185752B1

(12) United States Patent
Hendersen et al.

(10) Patent No.: US 6,185,752 B1
(45) Date of Patent: Feb. 13, 2001

(54) VENTABLE GAITER

(75) Inventors: Dylan Hendersen; Robert Link, both of Berkeley, CA (US)

(73) Assignee: Mountain Hardwear, Inc., Richmond, CA (US)

( * ) Notice: Under 35 U.S.C. 154(b), the term of this patent shall be extended for 0 days.

(21) Appl. No.: 09/309,210

(22) Filed: May 10, 1999

(51) Int. Cl.[7] ..... A41D 17/00; A41D 17/02

(52) U.S. Cl. ..... 2/242; 36/1.5; 2/23; 2/270

(58) Field of Search ..... 2/242, 23, 24, 2/61, 46, 227, 79, 270; 36/1.5, 2 R

(56) References Cited

U.S. PATENT DOCUMENTS 5,033,126 * 7/1991 Wruck et al. ..... 2/242
5,551,172 * 9/1996 Yu ..... 36/3 A
5,970,525 * 10/1999 Gallinot et al. ..... 2/242

* cited by examiner

*Primary Examiner*—Andy Falik
(74) *Attorney, Agent, or Firm*—Jay P. Hendrickson

(57) ABSTRACT

A gaiter having on its outside surface an air vent system which allows a user to vent the gaiter in order to permit air to pass through the side of the gaiter, and having on an opposite outside surface a coated fabric protective surface which has a coated fabric surface top seam which is slanted in a downward direction from the back of the gaiter to the front.

10 Claims, 4 Drawing Sheets

VENTABLE GAITER

BACKGROUND OF THE INVENTION

1. Field of the Invention

The present invention relates to the field of protective garments commonly called gaiters.

2. Description of Prior Art

Gaiters are well known in the art as protective garments which are used to overlap or cover the area between the top of a boot or shoe and a wearer's ankle or calf. Gaiters are commonly worn by hikers who are walking through terrain with loose gravel or snow and the gaiter prevents the gravel or snow from entering the boot. Gaiters are exceptionally useful to mountain hikers who are climbing through steep snow covered slopes. Gaiters are almost always worn by hikers wearing crampons, since the gaiter provides some protection from the sharp crampons which can stab the hiker's leg.

Unfortunately, there are several significant problems and limitations with present gaiter designs. One such problem is that gaiters are subject to a tremendous amount of wear on the side of the gaiter facing the opposite gaiter, this wear being particularly significant when the gaiters are worn with crampons, which continuously stab the gaiter. Another significant problem with gaiters is that they are notoriously warm and often overheat the legs. This heating problem is exacerbated by the fact that many gaiters extend upward to a position just below the knees in order to provide a sufficient seal and adequate protection against gravel and snow. At present, this problem has been addressed by garment designers by making the upper portion of the gaiter out of a waterproof and "breathable" fabric such as Gore Tex™. In extreme conditions, however, the breathable fabric does not provide sufficient relief and hikers often roll the gaiter down, which takes time and allows snow to be kicked up into the boot. This approach also creates another problem in that the upper breathable portion and lower protective portion must be connected by means of a seam. When using crampons in mountain climbing, the crampons tend to "catch" on the seam, leading to a premature destruction of the gaiter.

Therefore, there is a need for a gaiter that provides enhanced durability and, at the same time, provides an improved and more efficient method for reducing heat inside the gaiter.

SUMMARY OF THE INVENTION

The present invention is a gaiter having on its outside surface an air vent system which allows a user to easily and effectively vent the gaiter in order to permit air to pass through the side of the gaiter, and having on an opposite outside surface a protective surface coating which has a top seam which is slanted in a downward direction from the back of the gaiter to the front. The combination of the air vent system and protective surface coating presents a new and unique gaiter which is both comfortable and durable. The gaiter's comfort is facilitated by the air vent system which provides the user with an instantaneous cooling effect without having to either remove the gaiter or roll it down as is the common practice. Durability is provided by the protective surface coating which is designed to provide enhanced durability without unnecessarily increasing the heat retention characteristics of the gaiter.

Further features and advantages of the invention will become more readily apparent from a consideration of the following detailed description of the invention and the accompanying drawings.

A BRIEF DESCRIPTION OF THE DRAWINGS

DETAILED DESCRIPTION OF THE INVENTION

Figure 1:
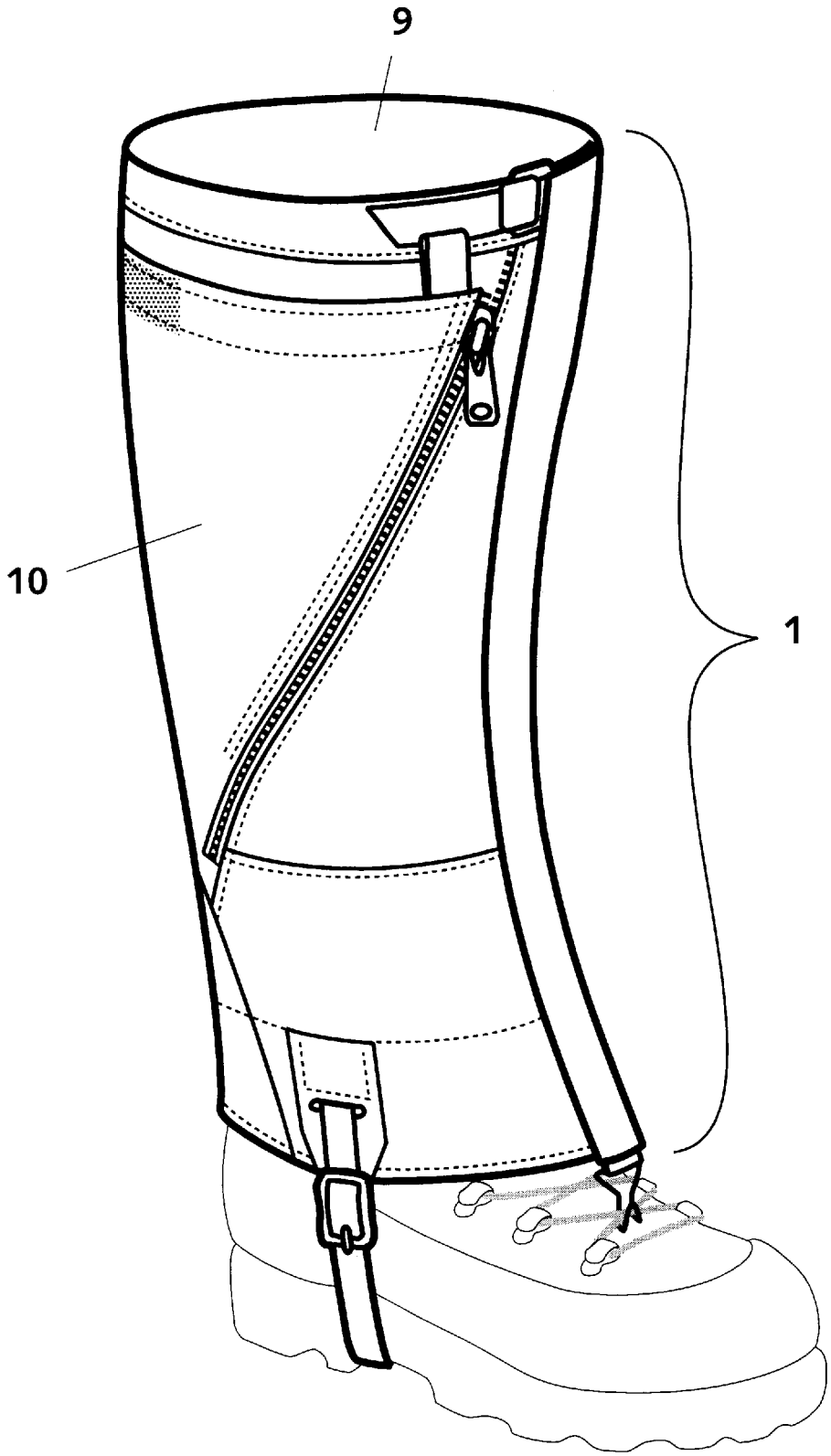
FIG. 1 is a perspective view of the gaiter.

As shown in FIGS. 1, 2, 3, and 4, the present invention is a gaiter 1 having a first side 2 and integral first side edge 3, a second side 4 and integral second side edge 5, with each side extending between the gaiter's top end 6 and bottom end 7. The gaiter's first and second side edges are releaseably attached by means of a front pile-type fastener 8, such as a Velco™ system to form a cylindrically shaped garment having an inside surface 9 and an outside surface 10, and a front side 11 and back side 12. More specifically, the front pile-type fastener 8 comprises a vertically extending inside pile-type strip 13 which is attached to the gaiter's inside surface 9 and located adjacent to the gaiter's second side edge 5, and an outside pile-type strip 14, which is attached to the gaiter's outside surface 10 and located adjacent to the gaiter's first side edge 3. The gaiter is formed into the cylindrically shaped garment by overlapping and mating the inside and outside pile-type strips. Typically, the gaiter is worn over the upper portion of the user's shoe or boot, and the user's ankle and calf.

Figure 2:
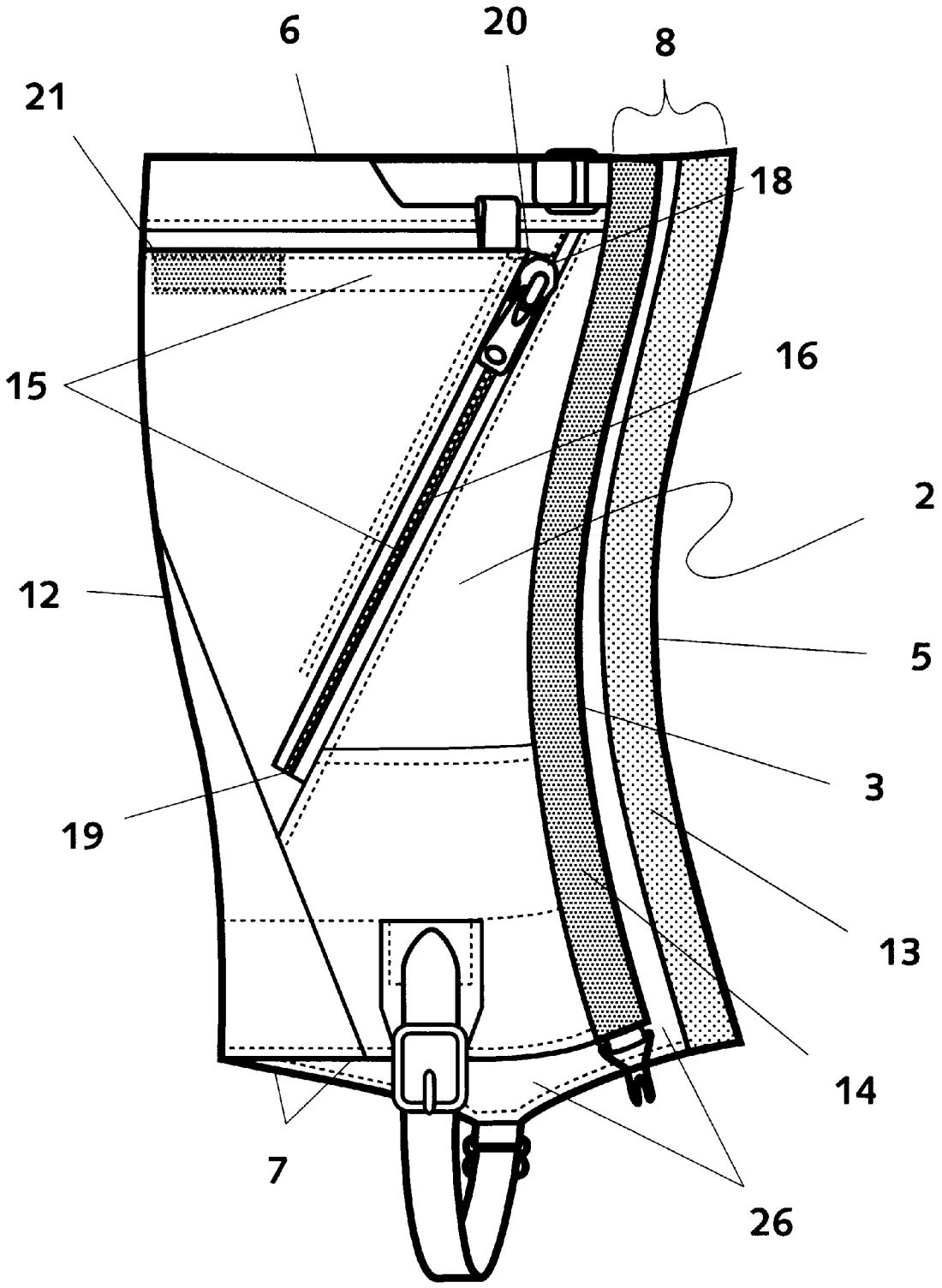
FIG. 2 is a side view of the gaiter illustrating the air vent system.
Figure 3:
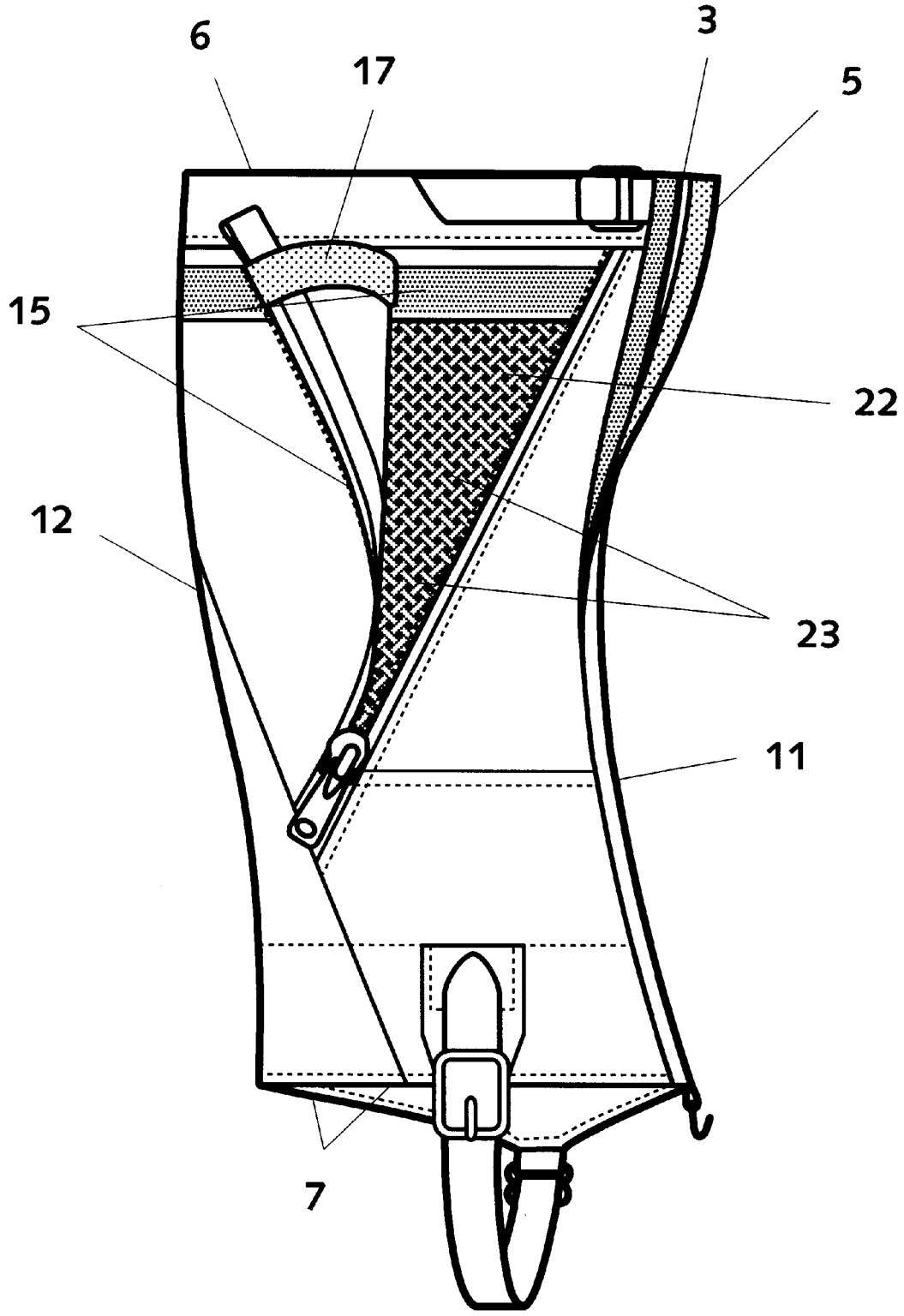
FIG. 3 is the same side view of the gaiter shown in FIG. 2, further illustrating the air vent system after it has been opened to permit air to pass through the side of the gaiter.

In a preferred embodiment, as shown in FIGS. 2 and 3, an air vent system 15 is located on the outside surface 10 of the gaiter's first side 2. The air vent system 15 includes a combination zipper 16 and side pile-type fastener 17. The zipper 16 extends downwardly from an opening zipper end 18, which is approximately adjacent to both the gaiter's top end 6 and its front side 11, to an opposite closing zipper end 19 which is located approximately adjacent to the gaiter's back side 12. The side velcro closure 17 has an opening pile-type end 20 which intersects the zipper's opening end 18, and has a closing pile-type end 21 which is positioned laterally from said opening pile-type end 20 to a point which is approximately adjacent to the gaiter's back side 12. In order to vent the gaiter 1, the zipper 16 is unzipped in a downward direction and the side pile-type fastener 17 is rolled or folded back in order to create an opening 22 in the side of the gaiter 1. A highly air permeable mesh fabric 23 spans the area defined by the opening and permits air to pass through the side of the gaiter 1.

Figure 4:
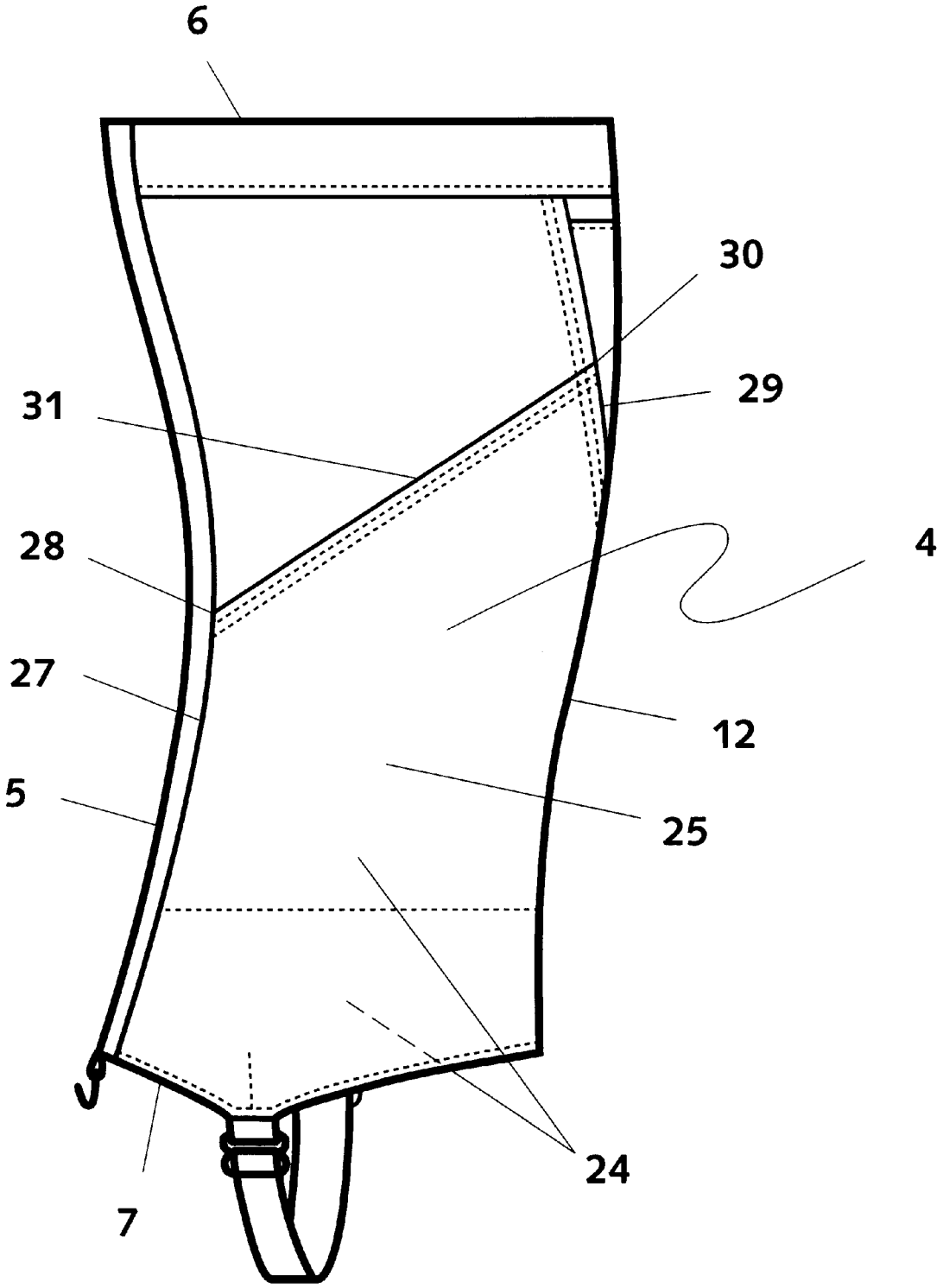
FIG. 4 is an opposite side view of the gaiter illustrating the protective surface coating.

As illustrated in FIG. 4, the invention further includes a coated fabric protective surface 24 comprising an outside coated fabric surface coating 25 and an inside surface coating 26 applied, respectively, to the outside coated fabric and inside adjacent surfaces of the gaiter's second side 4. Each of the surface coatings covers an area limited by: the gaiter's bottom end 7, extending between the second side edge 5 and back side 12; a coated fabric surface from seam 27, which is approximately adjacent to the gaiter's second side edge 5, extending from the gaiter's bottom end 7 to a front end point 28 which is located approximately one-half of the distance from the gaiter's bottom end 7 to its top end 6; a coated fabric surface back seam 29, which extends approximately vertically along the gaiter's back side 12, extending from the gaiter's bottom end 7 to a back end point 30 which is located approximately two-thirds of the distance from the gaiter's bottom end 7 to its top end 6; and a coated fabric top seam 31, which extends linearly and is slanted in a downward direction from the back end point 30 to the front end point 28. Preferably, the outside surface 25 and inside coated fabric surface 26 are formed by calendaring hypalon rubber into the outside gaiter surface 10 and to the opposite and adjacent inside surface 9. The resulting surface coating is extremely durable, pliable, waterproof and will not delaminate.

The combination of the air vent system 15 on the outside surface of one side of the gaiter 1 and the coated fabric protective surface 24 on the outside surface of the gaiter's opposite side provides a new and unique gaiter which solves the problems of overheating and durability associated with prior art gaiters. In addressing these problems, prior art gaiters have been designed to incorporate a "breathable" material such as Gore Tex™ into the upper half of the gaiter and an abrasion resistant material is incorporated into the gaiter's bottom half. Unfortunately, these prior art designs not only fail to provide a comfortable and durable gaiter, the designs actually exacerbate the gaiter's vulnerability to being punctured and torn by a hiker's crampons. When the upper breathable portion is sewn to the lower portion, a horizontal seam is created. This seam presents a "catch" point for a hiker's crampons which results in the premature destruction of the gaiter. In addition, the breathable material found in prior art gaiters does not provide sufficient air permeability in order to prevent an overheating condition in rigorous hiking conditions.

The gaiter 1 of the present invention successfully achieves the objective of providing a gaiter which is durable and at the same time exceptionally comfortable. The gaiter 1 is durable in two significant respects. First, the hypalon coating is applied using a calendaring method of application to the outside and inside surfaces of one side of the gaiter, which prevents the coating from delaminating, and it has been found that hypalon laminated fabric is exceptionally abrasion and puncture resistant. Second, experimental testing has revealed that in high stepping while wearing crampons, the usual point of wear and ultimate material failure is just above the seam between the lower reinforced part of the gaiter and the unreinforced upper portion. It was further discovered that the hiker's stepping action caused the crampons of the hiker's rear foot, as it came forward and was set down, to graze the gaiter at aft angle which was always slanted forward and downward. Thus, the gaiter 1 of the present invention places the coated fabric surface top seam 31 of the coated fabric protective surface 24 at an angle which is slanted downward approximately from the gaiter's back side 12 to the front side 11.

In addition to being exceptionally durable, the gaiter 1 of the present invention is easily and effectively vented by using its air vent system 15 to enhance the user's comfort in physically strenuous conditions. In use, a hiker merely leans down and unzips the zipper 16 downward, and rolls or folds the side velcro closure 17 backward, exposing the air permeable inner mesh 23. This simple and efficient action gives the hiker an immediate cooling effect, and eliminates the cumbersome and inefficient activity of rolling down the top portion of the gaiter.

It should be apparent that many modifications may be made to the present invention without departing from the essential teachings of the invention. Accordingly, it will be understood by those skilled in the art that, within the scope of the appended claims, the invention may be practiced in embodiments other than those specifically described in this application.

I claim:

1. A gaiter comprising:

an air vent means located on a side of the gaiter, said air vent means having a gaiter opening which allows air to pass through the side of the gaiter and an air permeable mesh which spans the gaiter opening, said air vent means further having a zipper which extends downwardly from an opening zipper end to an opposite closing zipper end, and having a pile-type fastener extending between an opening pile-type end, which intersects the zipper, and an opposite closing pile-type end, which is positioned laterally from said opening pile-type end, whereby the zipper may be unzipped and pile-type fastener may be opened in order to uncover the gaiter opening and the air permeable mesh which allow air to pass through the side of the gaiter.

2. A gaiter comprising:

a) a first side and integral first side edge, and an opposite second side and integral second side edge, with each side extending between the gaiter's top and bottom ends;

b) a gaiter closure means which overlaps the first side edge and the second side edge in order to form a cylindrically shaped garment having an inside and outside surface and a front and back side; and c) an air vent means located on either the first side or second side of the gaiter, said air vent means having a gaiter opening which allows air to pass through the side of the gaiter and an air permeable mesh which spans the gaiter opening, said air vent means further having a zipper which extends downwardly from an opening zipper end to an opposite closing zipper end, and having a pile-type fastener extending between an opening pile-type end, which intersects the zipper, and an opposite closing pile-type end, which is positioned laterally from said opening pile-type end, whereby the zipper may be unzipped and pile-type fastener may be opened in order to uncover the gaiter opening and the air permeable mesh which allow air to pass through the side of the gaiter.

3. A gaiter comprising:

a coated fabric protective surface located on a side of the gaiter, said protective surface having a coated fabric surface top seam which is slanted in a downward direction from the back of the gaiter to the front.

4. A gaiter comprising:

a) a first side and integral first side edge, and an opposite second side and integral second side edge, with each side extending between the gaiter's top and bottom ends;

b) a gaiter closure means which overlaps the first side edge and the second side edge in order to form a cylindrically shaped garment having an inside and outside surface and a front and back side; and c) a coated fabric protective surface comprising an outside coated fabric surface located on the outside surface of either the gaiter's first or second side and an inside coated fabric surface located on the inside surface of the gaiter, opposite and adjacent to the outside coated fabric surface, the outside and inside surface coatings extending between the front and back sides of the gaiter, and between the gaiter's bottom end and a coated fabric surface top seam, said top seam extending between a back end point and an opposite front end point, with said back end point being located higher than the front end point, whereby the gaiter's coated fabric surface top seam is slanted in a downward direction from the back of the gaiter to the front.

5. The gaiter of claim 4 in which the outside coated fabric surface is formed by calendaring hypalon rubber into the outside surface of the gaiter, and the inside coated fabric surface is formed by calendaring hypalon rubber into the opposite and adjacent inside gaiter surface.

6. A gaiter comprising:

a) an air vent means located on a side of the gaiter, said air vent means having a gaiter opening which allows air to pass through the side of the gaiter, and an air permeable mesh which spans the gaiter opening; and b) a coated fabric protective surface located on a side of the gaiter, said protective surface having a coated fabric surface top seam which is slanted in a downward direction from the back of the gaiter to the front.

7. A gaiter comprising:

a) a first side and integral first side edge, and an opposite second side and integral second side edge, with each side extending between the gaiter's top and bottom ends;

b) a gaiter closure means which overlaps the first side edge and the second side edge in order to form a cylindrically shaped garment having an inside and outside surface and a front and back side;

c) an air vent means located on either the first side or second side of the gaiter, said air vent means having a gaiter opening which allows air to pass through the side of the gaiter and an air permeable mesh which spans the gaiter opening; and d) a coated fabric protective surface comprising an outside coated fabric surface located on the outside surface of either the gaiter's first or second side and an inside coated fabric surface located on the inside surface of the gaiter, opposite and adjacent to the outside coated fabric surface, the outside and inside surface coatings extending between the front and back sides of the gaiter, and between the gaiter's bottom end and a coated fabric surface top seam, said top seam extending between a back end point and an opposite front end point, with said back end point being located higher than the front end point, whereby the gaiter's coated fabric surface top seam is slanted in a downward direction from the back of the gaiter to the front.

8. The gaiter of claim 7 in which the air vent means includes a zipper which extends downwardly from an opening zipper end to an opposite closing zipper end, said air vent means further includes a pile-type fastener extending between an opening pile-type end, which intersects the zipper, and an opposite closing pile-type end, which is positioned laterally from said opening pile-type end, whereby the zipper may be unzipped and pile-type fastener may be opened in order to uncover the gaiter opening and air permeable mesh which allow air to pass through the side of the said gaiter.

9. The gaiter of claim 7 in which the outside coated fabric surface is formed by calendaring hypalon rubber into the outside surface of the gaiter, and the inside coated fabric surface is formed by calendaring hypalon rubber into the opposite and adjacent inside gaiter surface.

10. The gaiter of claims 2, 4 or 7 in which the gaiter closure means includes an inside pile-type strip which is attached to the gaiter's inside surface and located adjacent to the gaiter's second side edge, and an outside pile-type strip which is attached to the gaiter's outside surface and located adjacent to the gaiter's first side edge, whereby the cylindrically shaped garment is formed by overlapping and mating the inside and outside pile-type strips.

* * * * *